United States Patent [19]

Ingvason

[11] 4,111,144

[45] Sep. 5, 1978

[54] SHIP'S DOCKING PLANT

[76] Inventor: Sigurdur Ingvason, Gårdesvägen 31, Hovås, Sweden, 43080

[21] Appl. No.: 753,209

[22] Filed: Dec. 22, 1976

[30] Foreign Application Priority Data

Jan. 12, 1976 [SE] Sweden ..... 7600193
Nov. 10, 1976 [SE] Sweden ..... 7612484

[51] Int. Cl.[2] ..... B63C 1/02
[52] U.S. Cl. ..... 114/48; 405/3
[58] Field of Search ..... 114/44, 45, 46, 48, 114/49, 65 R, 258, 259, 263, 264, 51; 61/64, 65; 187/9 R

[56] References Cited

U.S. PATENT DOCUMENTS

| | | | |
|---|---|---|---|
| 1,871,475 | 8/1932 | Smith | 114/263 |
| 2,241,798 | 5/1941 | Weiss | 187/9 R |
| 2,576,928 | 12/1951 | Engstrand | 114/45 |
| 2,977,920 | 4/1961 | Foster | 114/46 |
| 3,276,211 | 10/1966 | Drake | 114/45 |
| 3,691,977 | 9/1972 | Eubanks | 114/51 |

FOREIGN PATENT DOCUMENTS

| | | | |
|---|---|---|---|
| 2,042,850 | 3/1971 | Fed. Rep. of Germany | 114/45 |

*Primary Examiner*—Trygve M. Blix
*Assistant Examiner*—Sherman D. Basinger
*Attorney, Agent, or Firm*—Cantor and Singer

[57] ABSTRACT

A ship's docking plant includes a floating platform, partly enclosing a vertically displaceable docking member, providing large working areas around the same, when in raised position. The docking member is retained in relation to the platform by a vertical guide means at the inward, transverse side of the docking member, said guide means permitting the docking member to obtain various angular positions with respect to a horizontal plane, in the longitudinal, as well as in the transverse direction. The docking member is, along its longitudinal sides, connected to the platform by means of reversible chain winches, permitting an adjustment of the position of the docking member in relation to a horizontal plane, when lowered down.

7 Claims, 11 Drawing Figures

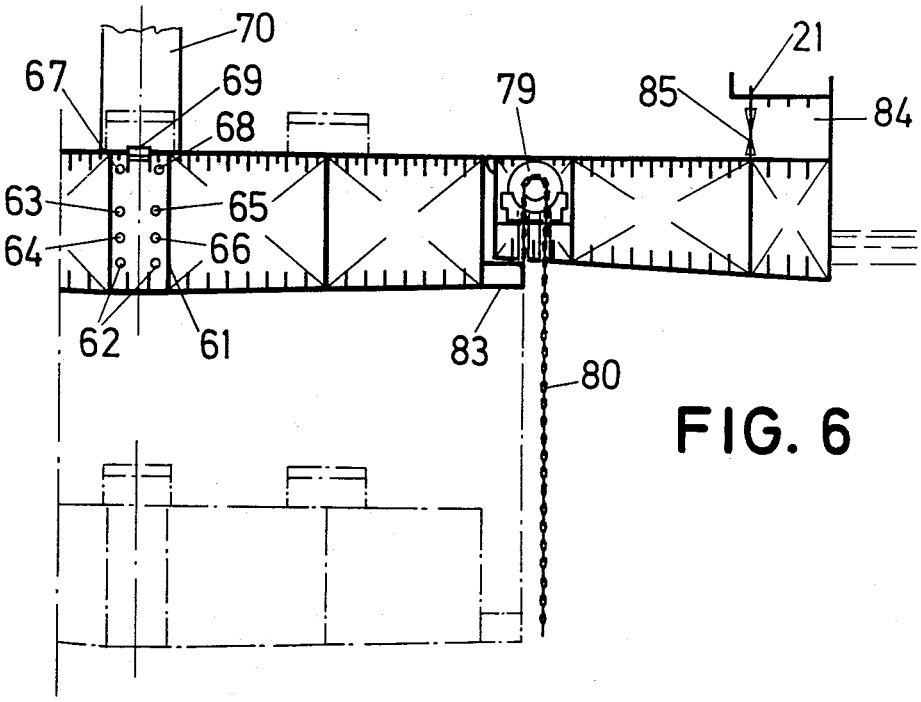
FIG. 6
FIG. 7
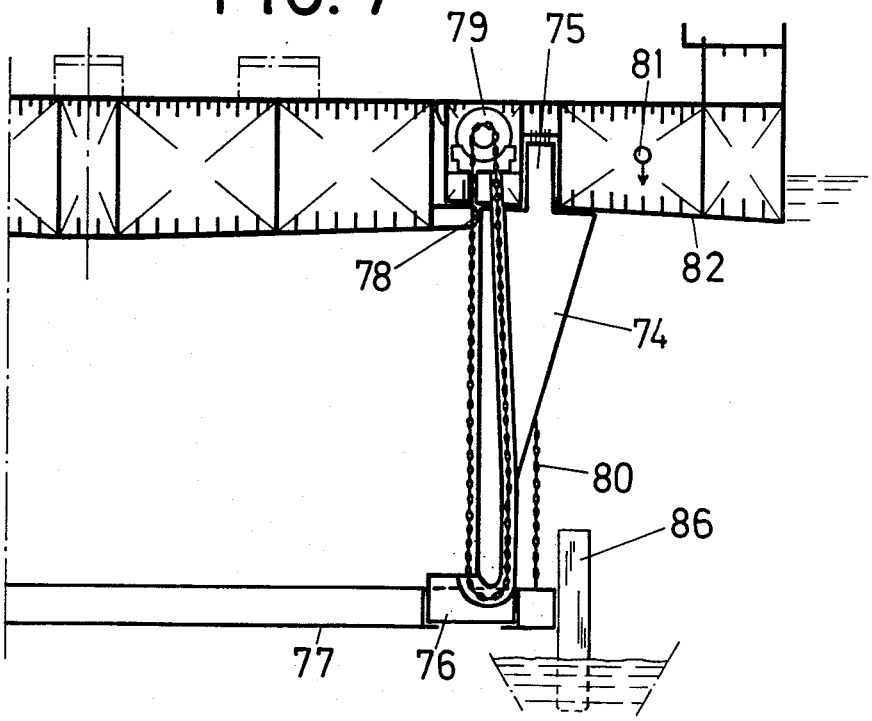

SHIP'S DOCKING PLANT

BACKGROUND OF THE INVENTION

Repair and service works at a ship's hull are usually performed in a floating dock. This should have the capacity to lift the ship, possibly containing some cargo, and includes a bottom member dimensioned with respect to the biggest ship expected to be handled, and two longitudinal side walls.

The side walls form a considerable obstacle during work in the dock, they make transports to and from the working sites below the hull more difficult, and they prevent the use of rational machines for instance for cleaning and painting the bottom plating.

SUMMARY OF THE INVENTION

Instead of these obstructing side walls it is now proposed that the member forming the vertically displaceable docking bottom is surrounded by a horizontal platform deck having sufficient extension to provide the necessary stability, and offering large working areas immediately adjacent to a raised ship, and facilitating access thereto from at least three sides. A plant according to the invention is characterized in that it includes a floating platform providing a working area, which along three sides (two longitudinal sides and one transverse side) encloses a rectangular docking member having displacement tanks and a plane deck, said docking member being adapted in working position to be raised so its deck will be substantially level with said working areas and to be lowered to a position permitting the reception or the removal, respectively, of a ship at its fourth side.

This platform is the supporting structure when the docking member, and the hull resting thereon, during a vertical displacement lose their own stability.

On many occasions it may be necessary to take care of a ship which due to some damage has a considerable list, or is trimmed down by the stern or by the stem. In order to avoid detrimental, local stresses in the ship, or in the docking member, respectively, it is desirable to bring the latter to a position compatible with the ship's bottom, so contact over a substantial area between the docking member and the bottom of the ship is obtained, before the raising operation is initiated, a preliminary step thereof implying bringing the ship upon an even keel.

Such work presupposes a certain mobility between the docking member and the platform, and according to a development of the invention the docking member, at its inward, transverse side is arranged to co-operate with the juxtaposed side of the platform by way of guide means including a guide member having a T-shaped cross-section at one of said juxtaposed sides on a vertical guiding channel enclosing said guide member at the other of said sides, the guide means and the channel being adapted to permit the docking member to occupy different angular positions with respect to longitudinal and/or transverse axes through the guide member.

In order to obtain an exact location of the lowered docking member, the longitudinal sides thereof are connected to the platform by means of a number of chain winches. At least some of these winches should preferably be reversible and the chains being formed as endless loops so the docking member can be pulled also downwards for adjustment purposes. The docking member is preferably provided with a service tunnel running centrally in its longitudinal direction, said tunnel at the inward end of the docking member communicating with a vertical tower structure, having a sufficient height to reach above water level, also when the docking member is in its fully sunk position.

The branches of the platform are designed in such a manner that the displacement point of gravity at each branch is located outside the geometric center line of the pertaining branch, as counted from the docking member, the latter being provided with ledge portions extending outwardly below the platform branches, to exert an upward pressure thereon, when being brought to the fully raised position.

The platform may, adjacent to the inward end of the docking member carry workshops, and may along at least one of its longitudinal sides be adapted to serve as a quay being provided with crane means serving such quay.

BRIEF DESCRIPTION OF THE DRAWINGS

FIG. 6 is a cross section along line VI—VI in FIG. 1 with the docking member in sunk position, FIG. 7 shows a section along line VII—VII in FIG. 1.

DESCRIPTION OF SOME PREFERRED EMBODIMENTS

Figure 1:
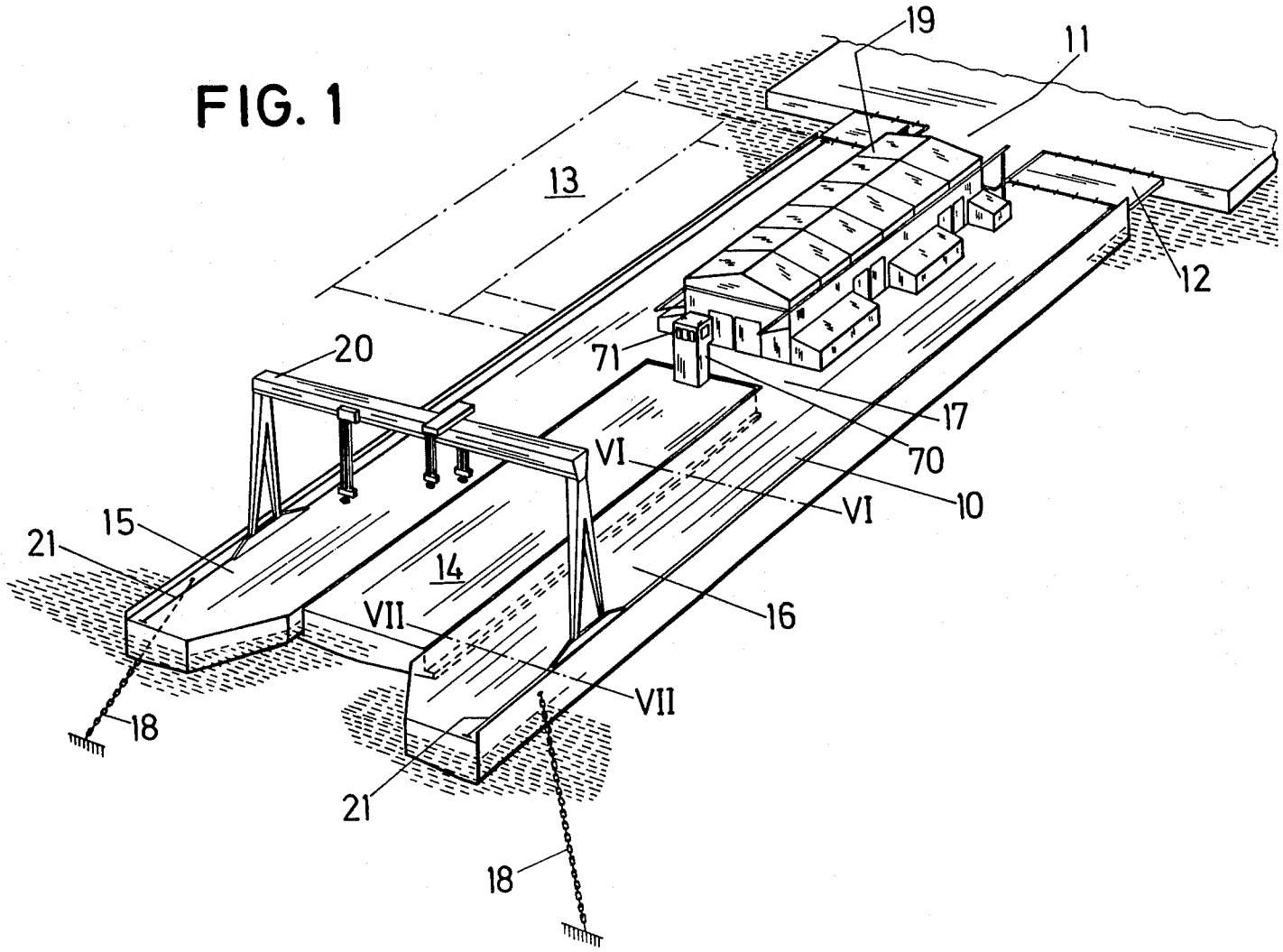
FIG. 1 is a perspective view of a plant according to the invention.

The plant shown in FIG. 1 is in the first hand adapted for repairing ships, but may of course also be used for new-building.

The plant includes a floating, basically U-shaped platform 10, which, in a well known manner, is composed of pontoons. The latter are provided with valves and pumps (not shown), so the platform may be maintained horizontal and at a suitable level by trimming with water in the usual manner.

The base of the U is directed towards an embankment 11 and an articulated ramp 12 permits communication by vehicles between the embankment and the platform. Alternatively the platform may be connected to an embankment at one of its longitudinal sides, as indicated by dotted lines at 13. The end of the platform remote from the embankment may be moored by suitable anchoring means, two of which are shown at 18. The branches of the U define between themselves a rectangular opening, within which a docking member 14 is fitted. Contrary to common practice the docking member is not provided with side walls, and it is arranged in such a manner that it can be raised to a position flush with the surrounding portions of the platform deck.

Those portions, thus, will form a working area 15 and 16, respectively, along the longitudinal sides of the docking member, and a working area 17 at the inward end thereof. Spaced from, but aligned with the docking member 14 a repair shop 19, including stores and localities for the personnel, is fitted.

A portal crane 20 straddles working areas 15 and 16 as well as the docking portion 14 and can travel along tracks 21, all the way along the platform, thus also over repair shop 19. The roof of this building is composed of axially slideable members, to provide openings so machinery components may be transferred directly from a docked ship to the repair shop, and back again.

The docking member, 14, will during raising and lowering be guided by supports directed downwardly from the platform. These supports may be designed as frame-works, or a box structures located along three sides of the opening between the branches of the platform. Some preferred embodiments of such guides will be described in connection with following figures.

Figure 2:
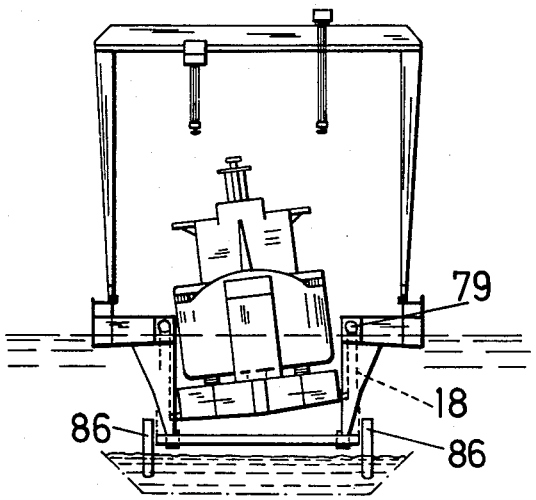
FIG. 2 shows a cross-section through the plant during the reception of a ship having noticeable list.
Figure 4:
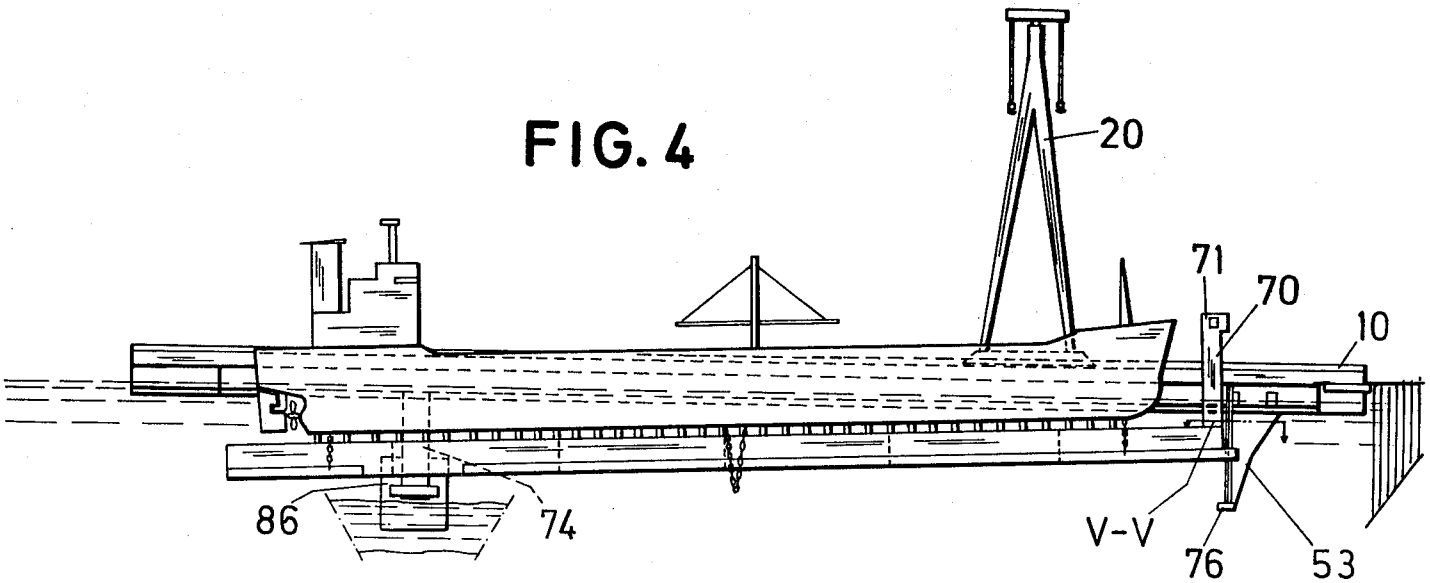
FIG. 4 shows a longitudinal section through the plant during the docking of a ship trimming down by the stern, FIG. 5 on a larger scale shows a detail of the guide means at the inward end of the docking section.

As is evident from FIG. 2 it may be necessary to accomodate a ship having a considerable list, and FIG. 4 further shows that a noticeable trim may be expected on occasions. Those deviations from the normal position of the ship will often occur simultaneously, which means that the docking member must be versatile and widely adjustable when in the lowered position.

This is according to the invention attained by connecting the inward end of the docking member with the platform by way of a centrally located, vertical guide means, the docking member, along its longitudinal sides being rather freely guided in relation to the platform. The docking member furthermore is adjustable by means of a number of chain winches, which make possible a better positioning of the docking member in relation to a damaged ship's bottom, than is possible solely by trimming the docking member by the introduction of, or removal of, ballast water.

The platform shall beside forming the working areas 15, 16, 17, provide support for a number of activities around the docked ship. It has, thus, a considerable displacement and within the same may be located stores for tools and spare parts, smaller workshops for activities pertaining to the operation of the dock, as well as for simple repairs, not requiring much space or equipment, lavatories and other localities for personel, as well as the machinery for operating the plant.

The platform further includes a number of tanks for the reception of ballast water, sewage, slop and possible petroleum products from a docked ship.

Figure 3:
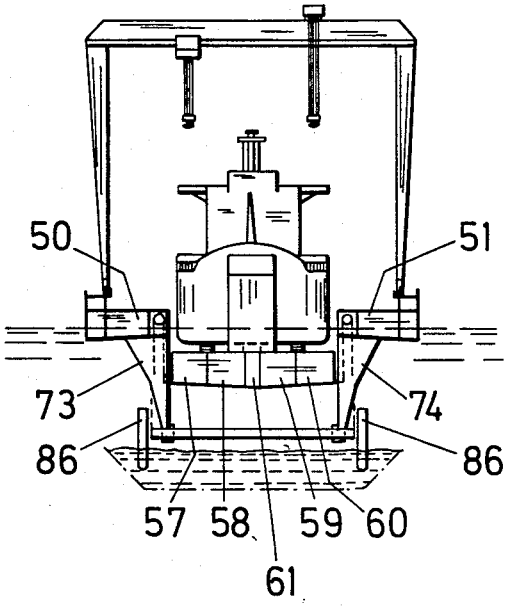
FIG. 3 shows a docking operation beginning in FIG. 2, about completed.
Figure 5:
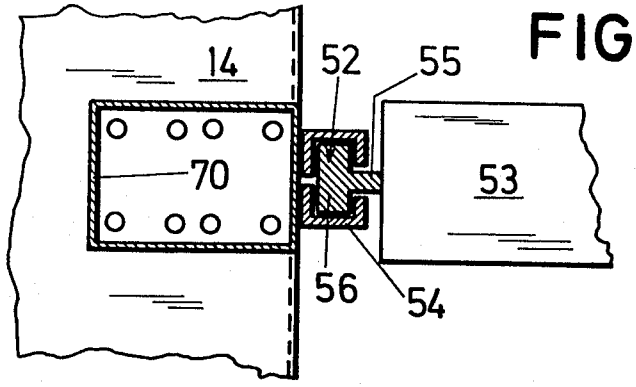

The platform encloses the docking member as a U and includes two parallel branches 50, 51 (FIGS. 2 and 3). The docking member is, as is best evident from FIGS. 4 and 5, connected to the platform by a guide means, including a guide member 52 mounted upon a support structure 53, directed downwardly from the platform. This guide member has an enlarged head 56 mounted upon a neck portion 55 and is manufactured of a stainless steel alloy having high strength and corrosion resistant properties. The docking member 14 is centrally, at its inward transverse end provided with a vertical channel 54 adapted to enclose the head 56 at the guide means, and simultaneously to permit deviations by the docking member with respect to a horizontal plane through the guide means, in the longitudinal direction as well as in the transverse direction. A reversed positioning of the components, i.e. with the guiding member at the docking member, is of course also possible.

The docking member is composed of a large number of tanks 57, 58, 59, 60, preferably at least two to each side of a central service tunnel 61 running in the longitudinal direction of the docking member. These tanks are, in the longitudinal direction of the docking member, subdivided into chambers provided with means for supplying and withdrawing ballast water in such a manner that a satisfactory distribution of the displacement forces will be obtained, and an adaptation of the position of the docking member in a general way with respect to list, trim, hogging and sagging positions of a ship to be docked is possible.

Ballast water drains 62, as well as conduits 63–66 for service fluids, such as compressed air, gas, steam, fresh and salt water, as well as electricity are arranged within the service tunnel. Pumps and valves for handling the ballast water are also accessible from the tunnel. When filling and emptying tanks 57–60 it is necessary to exhaust and to permit access of air, respectively, to the tanks. Ventilation ducts 67, 68 are also fitted in the tunnel. The service fluid conduits 63–66 may, by way of water tight man-hole openings 69 be connected to consumers at or in a docked ship. In this manner it is possible largely to avoid such hoses and cables, which normally hamper transports at a dry-dock's bottom.

At the inward end of the docking member there is a communication tower 70 having a sufficient height to extend above water level, also when the docking member is brought to its lowermost position. At the top of this tower there is an operator's cabin 71, from which the raising and the sinking of the docking member, as well as possible adjustments thereof in relation to the horizontal plane are monitored. This tower permits access to the service tunnel independently of the position of the docking member, and by way of the same electric current to the pump motors is supplied. The tower also includes connections to the service conduits 63–66.

The guide means 52–54 at the inward end of docking member 14 ensures an axial positioning in relation to the platform, but it is desirable also to guide the docking member in the transverse direction. To that end transverse guides 73, 74 are provided adjacent to the outward ends of the platform branches.

These guides are, as its support 53 at the inward end of the docking member, formed as displacing box structures, which are provided with projections 75 in their top portions, fitting into mating recesses at the platform branches. These guides, 73, 74, will be retained in their respective positions due to their inherent buoyancy, but in order to safeguard the positioning bolted connected may be arranged above water level.

The guides 73, 74 and the support 53 are, at their lowermost ends, each provided with an inwardly directed projection 76, which prevents the docking member, accidentally to sink too far down.

The transverse guides are interconnected, below the docking member, by means of a cross-beam 77. This retains the lowermost ends of guides 73, 74 in a definite position in relation to each other, that is to counteract inwardly as well as outwardly directed forces possibly acting upon the guides. The cross-beam 77 is designed as a displacing box structure, which fits into the guides with mating projections and recesses. The connections between the components may additionally be secured by means of chains.

To further support the lower ends of the guides with respect to outwardly directed forces a row of low piles 86 is driven into the bottom of the sea, just outside of the respective guide. With varying water levels the platform will move in its axial direction due to the fact that it is fixedly connected to the embankment at its inward transverse end. The row of piles 86 has sufficient length to accomodate such axial movements.

Fenders 78 are fitted at the longitudinal sides of docking member 14 for co-operation with transverse guides 73, 74. These fenders are made of a salt water resistant material and their outward faces are formed as portions of a circular arc having its centre at the longitudinal middle plane of the docking member.

Independently of possible list or trim the docking member may thus slide upwards or downwards.

The docking member is, as pointed out above, subdivided into a number of tank chambers whereby it is possible, beside the mere raising and lowering, to adjust the position with respect to the horizontal plane. For a careful adjustment of the position of the docking member a number of winches 79 are provided, preferably at least two along each longitudinal side of the docking members. These winches are of the same type as common mooring-winches and are connected to the docking members by means of chains 80. The winches are driven by electric or hydraulic means, and are provided with remote control means to be governed from operator's cabin 71.

As a first step in a docking operation the winches tighten the lowered docking member into contact with the bottom structure of the ship, but as an essential feature there is the necessity of ensuring, by physical forces, the stability conditions when the ship, including the docking member loses its own stability, just before the raising operation is terminated.

Should the pumping arrangement for one reason or the other, become inoperative, the winches are able to raise the docking member, however without any ship supported thereby.

The platform branches 50, 51 are designed to withstand high, local loads, caused by transport vehicles and by components being removed from or inserted into the ship, as well as from the portal crane 20 during heavy lifts. The center of gravity 81 of the displacement at such a branch is located outwardly of a geometric centerline, as counted from the inward longitudinal side of the branch. Such location of the center of gravity is obtained by designing the bottom plating 82 with an inclination downwards/outwards. In this manner the shape of the tanks will ensure that only a small residue of water or oil, respectively, will remain when the tanks are being emptied.

The docking member 14 is, along the lower edges of its longitudinal, as well as inward transverse side, provided with a projecting ledge 83, which reaches in below the branches 50 and 51, as well as the inward transverse side of the platform. This ledge will, when the platform is in its fully raised position, due to an excess of displacement force in the docking member, act uppn the platform from below, and will ensure that the platform is maintained in a level position and flush with the docking member, in spite of possible local loads.

A low wall 84 runs along the outward longitudinal sides of the platform. These walls, which should not be mistaken for the side-walls of a conventional dry-dock, are about three meters high, and will thus act as a windbreak for the personel working on the platform. Various service and staff localities may be housed in the walls, and access thereto is obtained through doors 85 directly from the working areas. As the rails 21 for the portal crane in this manner may be elevated above the working deck the risk of accidents caused by movements of the crane is reduced.

The platform may be moored by means of chains and/or be connected to an embankment. Instead of chains it is possible to locate a piling outside each of the platform branches in order to prevent movements of the platform away from an embankment.

Figure 8:
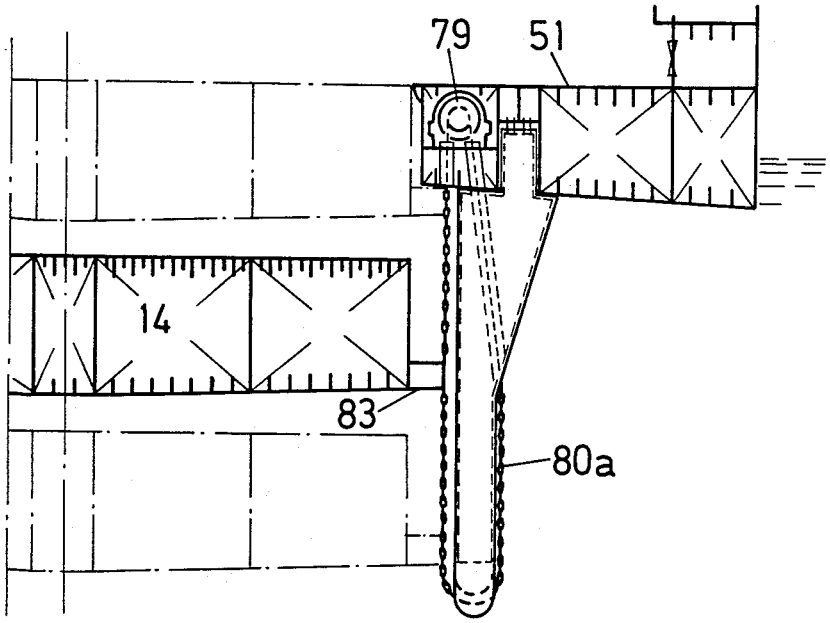
FIG. 8 shows a modified design of a chain winch forming part of FIG. 6.
Figure 9:
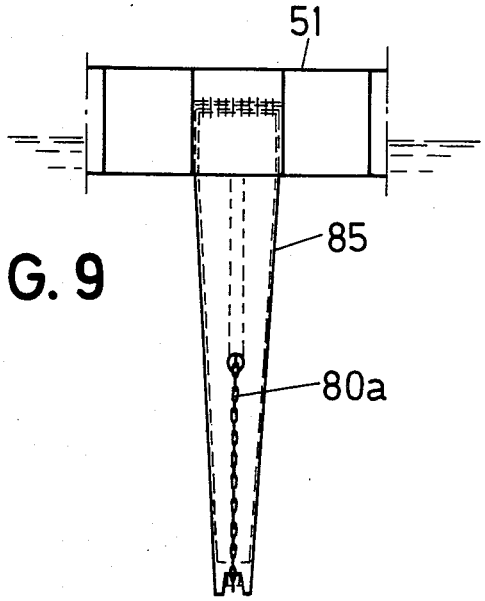
FIG. 9 is a view of the guide for the chain in FIG. 8, as seen from outside the platform.

In order to prevent the docking member from performing uncontrollable lifting movements due to occasional excess in local displacement, at least some of the chain winches along each longitudinal side of the docking member are reversible, and the chain 80 formed into an endless loop **80*a*, as shown in FIGS. 8 and 9**.

A chain loop **80*a* is guided in a bracket 85**, projecting downwardly from the platform, the loop normally hanging free from the lower end of the bracket.

The chain winches are in a manner common with anchor winches provided with a sprocket wheel and it is thus possible, for adjustment purposes, to pull the docking member downwards. It is here a question of comparatively small forces only, for bringing the docking member to its proper position.

Figure 10:
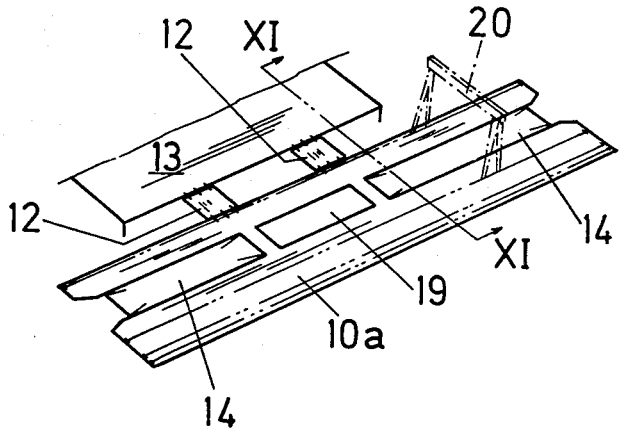
FIG. 10 shows, on a reduced scale, a plant including two docking members.

As is indicated in FIG. 10 the platform **10*a* may have a lay-out more or less as an H, and can thus accomodate two docking members 14, with workshops 19 located between the docking members. A portal crane 20** may serve both docking members.

Figure 11:
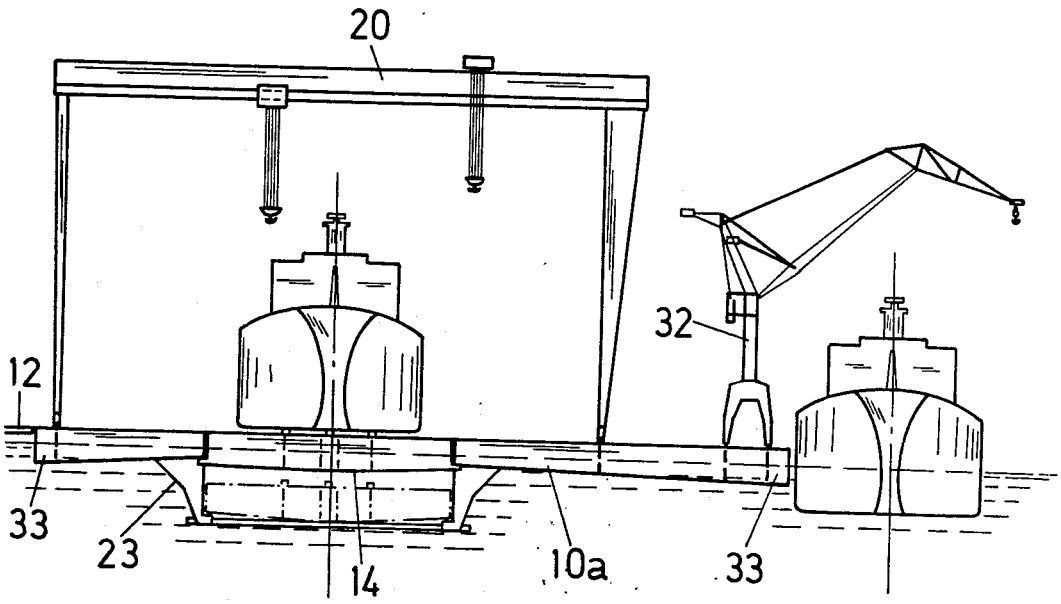
FIG. 11 shows, on a larger scale, a section through a modified embodiment of a plant, where one longitudinal side is designed as a quay and is provided with crane means.

FIG. 11 shows, on a larger scale, a somewhat modified plant according to FIG. 10. The platform **10*a*, the docking member 14 and the portal crane 20 are the same as described above. The longitudinal side of the platform, remote from an embankment 13 is designed as a quay for the outfitting of ships, and is provided with rails for a crane 32. As in the previous embodiments the outwardly longitudinal sides of the platform are strengthened by box structures 33** being deeper than the main part of the platform. Also these box structures may be utilizied for stores, staff localities and so forth.

In this embodiment it is necessary for the portal crane 20 to straddle one of the branches and the docking member only, the quay crane 32 having a sufficiently long jib to reach at least partly over the docking member.

Further modifications may be made within the scope of the appended claims. A plant of the type described here is eminently suited to handle floating drilling rigs, where it hitherto has bee impossible to do any dry-docking due to the considerable breadth of such rigs. A plant suitable for the handling of drilling rigs will have a docking member being about square, i.e. considerably broader than a conventional ship's dry-dock.

If there is a considerable distance between the outward ends of the branches 50, 51 it will be advantageous to provide an easily dismountable bridge structure outside the docking member. Such a bridge structure may be designed as a floating pontoon and be provided with a travelling track permitting communication between working areas 15 and 16.

What I claim is:

1. A ship's docking plant comprising (A) a floating platform including at least one pair of parallel branches, defining between themselves a substantially rectangular opening and having a plane deck to provide a working area surrounding said opening along three of its sides, (B) a docking member receivable in said opening and having a plane deck and being defined by two longitudinal and one inward, transverse side and one outward, transverse side, (C) a number of tanks in said docking member and means to admit and to expel, respectively, water from said tanks to lower and to raise said docking member, (D) a service tunnel running centrally in the longitudinal direction of said docking member, and (E) a tower structure at the inward, transverse side of said docking member, communicating with said service tunnel, and having sufficient height to reach above water level, also when the docking member rests in its lowermost position.

2. The plant according to claim 1 further including a portal crane, straddling the docking member as well as at least one of said platform branches, said crane being movable along said docking member, and over the working area at its inward end.

3. The plant according to claim 2 in which each branch of said platform, along its outward edge is provided with a low wall carrying rails for said portal crane, said walls being adapted to house service localities.

4. The plant according to claim 2 in which the working area located at the inward end of said docking member includes workshops carried by said platform.

5. A ship's docking plant comprising (A) a floating platform including at least one pair of parallel branches, defining between themselves a substantially rectangular opening and having a plane deck to provide a working area surrounding said opening along three of its sides, (B) a docking member receivable in said opening and having a plane deck and being defined by two longitudinal and one inward, transverse side and one outward transverse side, (C) a number of tanks in said docking member and means to admit and to expel, respectively, water from said tanks to lower and to raise said docking member, (D) a submerged, vertical guide for the docking member at each branch of the platform, remotely from the inward end of said docking member, and (E) guide means interconnecting the inward transverse side of said docking member and the juxtaposed side of said platform, said guide means including a guide member of basically T-shaped cross-section mounted at one of said juxtaposed sides of said docking member and said platform and a vertical channel member mating with and enclosing said guide member at the other of said juxtaposed sides, said guide member and said channel means cooperating so as to permit the docking member to occupy different angular positions with respect to longitudinal as well as tranverse axes through the guide member.

6. The plant according to claim 5 further including at least one chain operated winch means mounted at each branch of the platform, an endless chain loop at each of said winch means connected to the adjacent longitudinal side of the docking member, a downwardly directed, vertical guide for said chain loop and reversible driving means for said winch.

7. A ship's docking plant comprising:

(A) a floating platform which, in plan view, is formed substantially as an H having two pairs of parallel branches, each pair of branches defining between themselves a substantially rectangular opening and having a plane deck to provide a working area surrounding said opening along three of its sides, (B) two aligned but axially spaced docking members, each having a plane deck and being defined by two longitudinal and one inward, transverse side and one outward transverse side, (C) a number of tanks in each said docking member and means to admit and to expel, respectively, water from said tanks to lower and to raise said docking member, (D) said docking members being receivable in said openings between the branches of the platform, in raised position presenting their decks flush with the deck of said platform, (E) ledge portions, extending outwardly from said docking members so as to engage said platform branches when said docking members are brought to the position where their decks are flush with the deck of the platform, (F) common facilities located between said docking members, and (G) rails permitting movement of crane means along both docking members.

* * * * *